United States Patent [19]

Codecasa

[11] 4,376,632

[45] Mar. 15, 1983

[54] PROCESS AND PLANT FOR THE CONTINUOUS MERCERIZATION OF RAW OR COLORED OPEN OR TUBULAR KNITTED FABRIC

[75] Inventor: Vittorio Codecasa, Milan, Italy

[73] Assignee: E. Mottana S.p.A., Milan, Italy

[21] Appl. No.: 335,419

[22] Filed: Dec. 29, 1981

Related U.S. Application Data

[63] Continuation of Ser. No. 92,407, Nov. 8, 1979, abandoned.

[51] Int. Cl.[3] ..... D06M 1/02; D06F 31/00

[52] U.S. Cl. ..... 8/125; 8/151; 68/9

[58] Field of Search ..... 8/125, 151

[56] References Cited

U.S. PATENT DOCUMENTS

| | | | |
|---|---|---|---|
| 1,807,762 | 6/1931 | Thies | 8/125 |
| 3,542,503 | 11/1970 | Kullman et al. | 8/125 |
| 3,664,158 | 5/1972 | Skaathun et al. | 8/125 |
| 4,022,574 | 5/1977 | Ichihara | 8/125 |
| 4,095,944 | 6/1978 | Duckworth | 8/125 |
| 4,112,532 | 9/1978 | Catallo | 8/151 |
| 4,184,846 | 1/1980 | Diggle | 8/151 |
| 4,226,598 | 10/1980 | Schiffer | 8/151 |

*Primary Examiner*—Maria Parrish Tungol

*Attorney, Agent, or Firm*—Karl W. Flocks; Sheridan Neimark

[57] ABSTRACT

This invention relates to a process and plant for the continuous mercerization of raw or colored, open or tubular knitted fabric. According to the invention the knitted fabric is impregnated with soda, passed through a series of rollers for causing reaction of the soda, passed through a series of at least five wash stages, and deeply wringed and collected in the case of raw fabric or deeply wringed, sized and further deeply wringed in the case of colored fabric. One or more dimensional control sections are distributed along the cycle.

1 Claim, 2 Drawing Figures

PROCESS AND PLANT FOR THE CONTINUOUS MERCERIZATION OF RAW OR COLORED OPEN OR TUBULAR KNITTED FABRIC

This is a continuation of application Ser. No. 092,407, filed Nov. 8, 1979 now abandoned.

Up to the present time, tubular cotton knitted fabric has not been able to be mercerised industrially.

The impossibility of industrially mercerising tubular cotton knitted fabric has been overcome either by mercerising the yarn to be used for weaving the fabric, which involves very high processing costs and frequently produces defects which are observable only on the knitted fabric, or by impregnation treatment in a foulard with caustic soda, then storing in a roll and finally neutralising and washing, this treatment being improperly called mercisation but in reality consisting of simple fulling.

The present invention relates to a process and plant for the continuous mercerisation of both tubular and open knitted fabric whether in its raw or coloured state, and ensures that the finished product will have optimum dimensional stability, a high degree of brightness and a considerable increase in its elasticity and strength after treatment.

The process consists essentially of a series of successive operations comprising:

(a) impregnation with caustic soda under controlled tension—(b) passing the knitted fabric through a series of stabilising rollers in order to obtain reaction by the soda under conditions of movement—(c) stabilisation washing followed by neutralisation by passage through a series of (at least five) wash units, of which at least the first four are of the automatically controlled tension type—(d) deep wringing and collection in the case of the natural knitted fabric, or alternatively deep wringing, feeding into a sizing tank followed by deep wringing in the case of coloured knitted fabric—(e) one or more dimensional control sections situated before operation (a), after operation (b) and after operation (c). The plant for carrying out the process comprises a series of components disposed in sequence, such as to execute the aforesaid operations continuously.

Figure 1A:
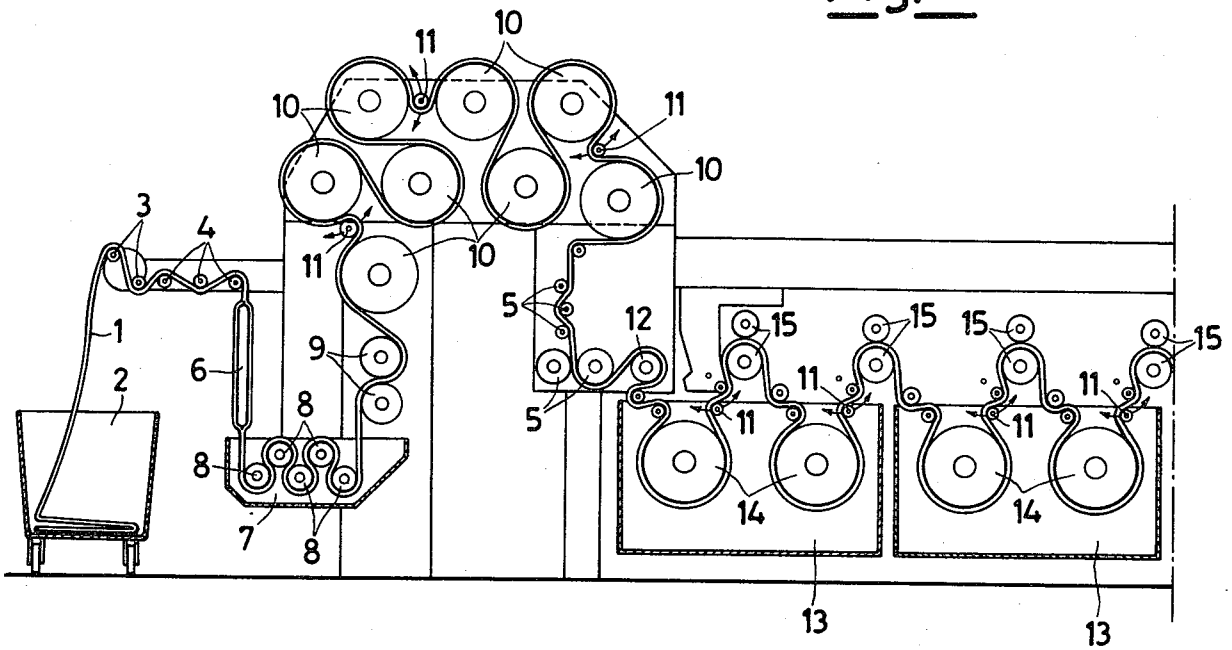
Figure 1B:
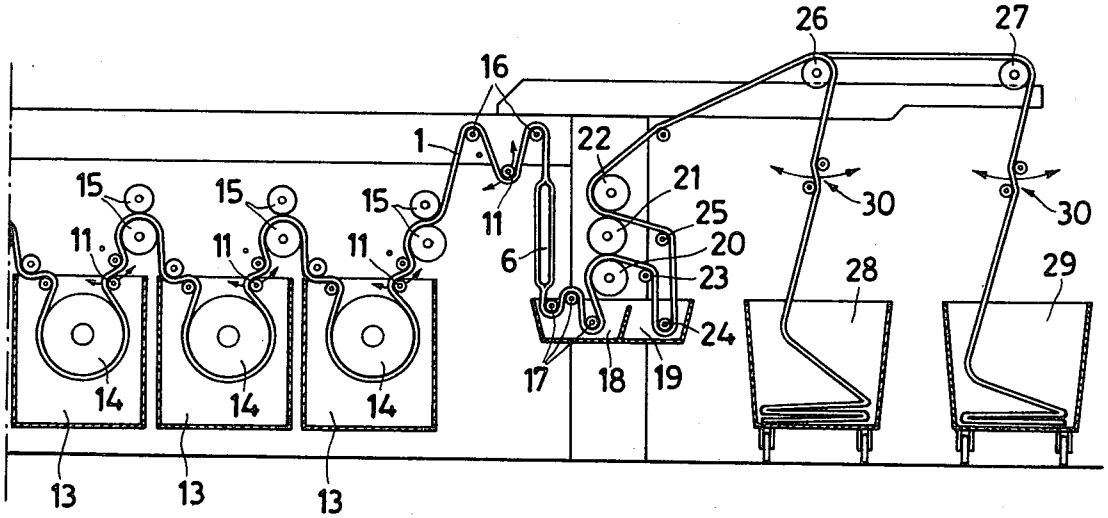

It will be more apparent from the description of the embodiment given hereinafter by way of non-limiting example with reference to the accompanying drawings of which:

FIGS. 1*a*, 1*b* are longitudinal sections through the plant according to the invention, wherein similar repeated equipment is given the same reference numeral.

The transverse dimension of the machine is chosen in accordance with the maximum commercial widths of such knitted fabric. The machine is able to process either one piece of knitted fabric at a time if its width is equal to or less than the maximum width of the machine, or two pieces of knitted fabric in parallel if their width is less than half the width of the machine. For this latter method, the only extra arrangement necessary is to provide a second discharge unit and double dimensional control devices to replace the single ones at each dimensional control section.

The machine according to the invention is constituted by:

a feed unit consisting of a series of cylinders 4 (three in the example of FIG. 1) preceded by a pair of variable speed feed cylinders 3 (the purpose of which is to give the knitted fabric the necessary controlled tension during impregnation) for withdrawing the knitted fabric 1 from its store 2 (a trolley in the case of FIG. 1, but it could be any other type such as a roll etc.) and for feeding it to the machine an arranging unit for the knitted fabric in which the fabric is arranged in a properly widened state without creases, and constituted either by a guide and widening device for the open knitted fabric 5, of known type, or by a widener for tubular fabric 6, also of known type.

As both the devices (for the open knitted fabric and for the tubular knitted fabric) cannot be easily indicated on the drawing in the same machine section, and as the embodiment in question comprises three such dimensional control units in various sections of the plant, said devices have been indicated on the drawing as alternatives, it being understood that both types of widening devices are present in each of the three sections, the particular type which is operated depending on whether flat or tubular knitted fabric is used. In the case of two pieces of fabric in parallel, it is possible to replace each of these devices by two of approximately half width.

an impregnation unit constituted by the tank 7 containing caustic soda solution, and in which a series of generally idle rollers 8 is disposed, between which the fabric to be impregnated is passed and is kept under tension by its passage between the rollers 9 of the subsequent wringing unit and the feed rollers 3.

a wringing unit consituted by two rollers 9 faced with synthetic material and adjustable in their degree of approach, their purpose being to deeply wring out the knitted fabric.

a reaction unit constituted by a series of rollers 10, of such a number as to create a passage for the knitted fabric in contact with the air for a sufficient time to obtain the reaction.

A further purpose of this unit is to regulate the transverse dimension of the knitted fabric so that it can be stabilised in the subsequent treatment at the required dimension.

For this purpose, the arrangement and diameter of the rollers must be such that the degree of adherence between the knitted fabric and the rollers is greater than the force by which it is pulled for feeding purposes, in order to prevent any transverse shrinkage if the fabric is required to possess, at the end of the reaction, the same width that it had on leaving the impregnation tank 7. However, it is also possible to vary the speed of the rollers in groups of two in order to give an increasing pull so as to obtain, at the end of the reaction, a fabric which is narrower than it was at its entry to the impregnation tank 7.

For this purpose, the rollers are provided in pairs with a speed adjustment device of known type operated by the tension sensors 11, which are also of known type.

a second width control unit constituted by a further two devices 5 and 6 identical to those installed upstream of the impregnation tank.

a wash, stabilisation and neutralisation unit consisting of a certain number of "wash stages" disposed in series, at least the first four of which are under automatically controlled tension, and each being constituted by the tank 13 in which a hollow perforated roller 14 rotates, over which the knitted fabric is passed. Inside the perforated roller there acts a pump which forces the water contained in the tank to circulate through the roller walls and the fabric weave from the outside to the inside of the roller, and at the same time rotates and automatically controls the speed of the perforated roller as is described in greater detail in the previous patent application No. 21613 A/77 of Mar. 24, 1977. Each roller is followed by a light wringing unit 15 provided with a speed regulator of known type controlled by the tension sensors 11 of the same type as those previously indicated with the same reference numeral.

The penultimate stage of this unit serves for neutralisation purposes, i.e. in order to eliminate the last traces of residual caustic soda solution so that the final wash can take place in the last stage.

It is indispensable that during this part of the process in which the knitted fabric is stabilised, it maintains its transverse dimension unchanged from the beginning to the end, and for this reason at least the first four wash stages are of automatically controlled speed.

a deviation unit constituted by three rollers 16 controlled by the sensor 11 a third dimensional control unit for the knitted fabric leaving the wash, consisting of a further two devices 5 and 6 identical to those previously installed and having the same function a deep wringing unit constituted by a collection tank 18 containing the three deviation rollers 17 and the three wringing rollers 20, 21, 22 faced with synthetic material a sizing unit constituted by the tank 19 and the deviation rollers 23 and 24 two discharge units constituted respectively by the deviation rollers 26 and 27 and each provided with a folding device 30.

The operation is as follows. The knitted fabric 1 to be mercerised originates from the trolley 2 and is passed in zig-zag manner through the adjustable speed rollers 4 and the feed rollers 3, the purpose of which is to guide it at controlled speed and tension towards the fabric arrangement section where it is widened and smoothed out so as not to comprise any wrinkles or creases. This is done by its passage through the widening device 5 in the case of flat fabric or through the widening device 6 in the case of tubular fabric.

As it proceeds along its path, the fabric is immersed in the impregnation tank 7 full of caustic soda solution by passing in a zig-zag manner about the rollers 8. During impregnation, the fabric is kept slightly taut.

On exit from the impregnation tank, the fabric passes through two deep wringing rollers which eliminate the excess reactive liquid, after which the reaction period takes place with the fabric continuously in movement by making the fabric take the path determined by the rollers 10 constituting the reaction unit.

These rollers rotate at a controlled speed and are governed in pairs by a series of tension sensors 11 which, if the transverse dimension of the fabric is not to change, match the speed of the rollers to the varying dimensional conditions of the fabric which during this stage undergoes shrinkage. However, by suitably varying the relative speed of the pairs of rollers 10, it is possible during this processing stage to change the transverse dimension of the fabric (in the sense of reducing it) so that it can be stabilised at said dimension during the next operation.

From here, the fabric passes through the second dimension control station under the control of the devices 5 or 6 according to whether the fabric is flat or tubular, by which the width is checked and possibly adjusted.

The wash period then begins, and the fabric is passed through a series of (at least five) wash stages 13 containing hot water, at least the first four of them being of the type comprising a drum rotating at an automatically controlled speed, and each being followed by a light wringing unit consisting of two wringing rollers 15, the speed of which is regulated by the said regulator units under the control of said tension sensors of known type 11.

On leaving the last wash stage, the fabric is deviated by the deviation unit consisting of the rollers 16 and sensor 11 and is subjected to a final dimensional control by which it passes through the devices 5 or 6 of the said type, according to whether the fabric is open or tubular.

From here, if the fabric is mercerised in its raw state, the fabric is fed to the drain tank 18 which collects and discharges both the liquid which drips off and the liquid from the subsequent deep wringing, which is carried out by the fabric passing between the wringing rollers (of the type faced with synthetic material) 20, 21 and 22, then passing over the discharge roller or rollers 26 and 27 and through the folder or folders 30 to be collected in the trolleys 28 and 29.

If the mercerised knitted fabric is already coloured, the fabric is passed through the wringing rollers 20 and 21, and is then passed over the deviation roller 24 immersed in the tank 19 containing size, and from here after being wrung between the rollers 21 and 22, it passes to the discharge rollers 26 and 27 and to the folders 30 for collection in the trolleys 28 and 29.

We claim:

1. A process for continuously mercerizing raw or colored open or tubular knitted fabric according to the following series sequence of successive operational steps:

(a) passing such fabric under controlled tension condition through a caustic soda solution thereby impregnating the fabric with such caustic soda;

(b) subjecting the impregnated fabric to a reaction phase by removing the impregnated fabric from the caustic soda solution and passing at least a first side of such impregnated fabric along an undulating path in supported relationship over a series of one or more pairs of stabilizing rollers and a second side of the impregnated fabric under a tension sensor disposed between such a pair of stabilizing rollers whereby under controlled tension with such impregnated fabric is being exposed to air during which time the caustic soda reacts with the fabric with the tendency to shrink the fabric longitudinally and transversely;

(c) controlling the tension of the fabric during the reaction phase by such tension sensors positioned between the pairs of the stabilizing rollers whereby the tendency of the caustic soda to shrink the fabric longitudinally and transversely during the reaction phase is effectively offset by the controlled tension applied to the fabric;

(d) passing the fabric through a series of at least five wash stages of which the first four are of the automatically controlled tension type and washing, stabilizing, and neutralizing the fabric during passage through such wash stages;

(e) deep wringing and collecting the fabric in the case of raw fabric, or alternatively deep wringing and sizing the fabric followed by deep wringing in the case of coloured fabric.

* * * * *